US008315531B2

(12) United States Patent
Nakajima

(10) Patent No.: US 8,315,531 B2
(45) Date of Patent: Nov. 20, 2012

(54) IMAGE-PROCESSING DEVICE, IMAGE-FORMING APPARATUS, IMAGE-PROCESSING METHOD, AND COMPUTER-READABLE MEDIUM

(75) Inventor: Takaharu Nakajima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 252 days.

(21) Appl. No.: 12/775,823

(22) Filed: May 7, 2010

(65) Prior Publication Data

US 2011/0076039 A1 Mar. 31, 2011

(30) Foreign Application Priority Data

Sep. 25, 2009 (JP) ..... 2009-220801

(51) Int. Cl.
*G03G 15/01* (2006.01)

(52) U.S. Cl. ..... 399/39

(58) Field of Classification Search ..... 399/38–40, 399/297–301; 430/43.1, 120.1, 123.56, 137.1
See application file for complete search history.

(56) References Cited

U.S. PATENT DOCUMENTS

| | | | | |
|---|---|---|---|---|
| 4,204,728 | A * | 5/1980 | Goshima et al. | 399/178 |
| 5,866,286 | A * | 2/1999 | Christy et al. | 430/123.56 |
| 6,996,358 | B2 | 2/2006 | Ayaki et al. | |

FOREIGN PATENT DOCUMENTS

| | | |
|---|---|---|
| JP | A-2000-98692 | 4/2000 |
| JP | B2-4136789 | 8/2008 |
| JP | A-2009-20222 | 1/2009 |

* cited by examiner

*Primary Examiner* — Hoan Tran
(74) *Attorney, Agent, or Firm* — Oliff & Berridge, PLC

(57) ABSTRACT

An image-processing device includes a selection unit that selects either a first operation mode or a second operation mode for representing a primary color by a combination of a first developer having a relatively light color of substantially the same hue as the primary color and a second developer having a relatively dark color of substantially the same hue as the primary color, wherein in the second operation mode, a larger amount of the first developer and a smaller amount of the second developer are used to represent a given intensity of the primary color than in the first operation mode; and a first conversion unit that converts a primary color signal representing the primary color into a first developer color signal representing an amount of the first developer and a second developer color signal representing an amount of the second developer.

9 Claims, 3 Drawing Sheets

IMAGE-PROCESSING DEVICE, IMAGE-FORMING APPARATUS, IMAGE-PROCESSING METHOD, AND COMPUTER-READABLE MEDIUM

CROSS-REFERENCE TO RELATED APPLICATIONS

This application is based on and claims priority under 35 U.S.C. 119 from Japanese Patent Application No. 2009-220801, which was filed on Sep. 25, 2009.

BACKGROUND

1. Technical Field

The present invention relates to an image-processing device, an image-forming apparatus, an image-processing method, and a computer-readable medium.

2. Related Art

As a technology relating to an image-forming apparatus, it is known to reproduce a primary color by combining a toner having a relatively light color and a toner having a relatively dark color. Primary colors are basic colors for color mixture. For example, in subtractive color mixture, primary colors are cyan, magenta, and yellow.

SUMMARY

In one aspect of the present invention, there is provided an image-processing device including a selection unit that selects either a first operation mode or a second operation mode for representing a primary color by a combination of a first developer having a relatively light color of substantially the same hue as the primary color and a second developer having a relatively dark color of substantially the same hue as the primary color, wherein in the second operation mode, a larger amount of the first developer and a smaller amount of the second developer are used to represent a given intensity of the primary color than in the first operation mode; and a first conversion unit that converts a primary color signal representing the primary color into a first developer color signal representing an amount of the first developer and a second developer color signal representing an amount of the second developer, wherein when the second operation mode is selected by the selection unit, the first conversion unit converts the primary color signal such that the first developer color signal obtained by the conversion represents a larger amount of the first developer and the second developer color signal obtained by the conversion represents a smaller amount of the second developer for a given value of the primary color signal than in the first operation mode, while an area of a medium covered by the first developer and the second developer is unchanged between the first and second operation modes.

BRIEF DESCRIPTION OF THE DRAWINGS

Exemplary embodiments of the present invention will be described in detail based on the following figures, wherein.

DETAILED DESCRIPTION

(1) Exemplary Embodiment

Figure 1:
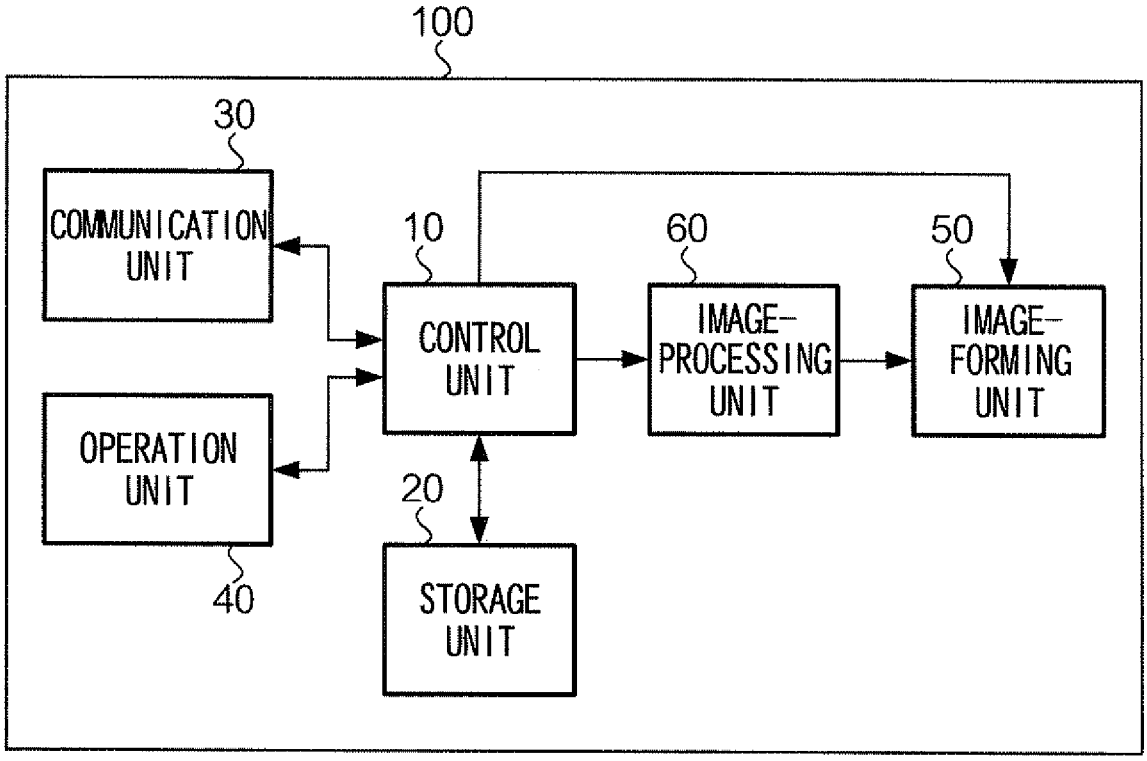
FIG. 1 is a block diagram showing a configuration of image-forming apparatus 100 according to an exemplary embodiment of the present invention.

FIG. 1 is a block diagram showing a configuration of image-forming apparatus 100. Image-forming apparatus 100 is provided with a variety of functions such as printing, scanning, and copying, and can form an image on a recording sheet, which is an example of a recording medium, with a toner, which is an example of a developer. Image-forming apparatus 100 includes control unit 10, storage unit 20, communication unit 30, operation unit 40, image-forming unit 50, and image-processing unit 60. Control unit 10 includes a CPU (Central Processing Unit), ROM (Read Only Memory), and RAM (Random Access Memory), and the CPU executes a control program stored in the ROM or storage unit 20 to control various parts of image-forming apparatus 100. Storage unit 20 is a storage device of non-volatile type such as a HDD (Hard Disk Drive), and stores various types of programs and data. Communication unit 30 can be constituted of any of a variety of types of moderns, for example, and communicates with an external device such as a personal computer. Operation unit 40 includes a display screen, a transparent touch panel disposed on the display screen, and multiple operation keys to receive operations of a user and provide information to the user by displaying an image on the display screen. Image-processing unit 60 may include an ASIC (Application Specific Integrated Circuit) and a memory, and performs image processing on image data provided from control unit 10 to generate an image signal, which is forwarded to image-forming unit 50.

Image-forming unit 50 functions to form an image on a recording sheet in accordance with the image signal received from image-processing unit 60. Image-forming unit 50 also forms an image on a recording sheet based on image data received at communication unit 30 from an external device. In this exemplary embodiment, image-forming unit 50 uses eight colors of toner to form an image. The eight colors are dark yellow (DY), dark magenta (DM), dark cyan (DC), dark black (DK), light yellow (LY), light magenta (LM), light cyan (LC), and light black (LK), wherein light black may be also referred to as gray. For example, toners of dark cyan and light cyan are used alone or in combination to reproduce an intensity of cyan, which is one of the primary colors. It should be noted that when one of the two colors having a substantially identical hue is darker than the other, the darker color has a lower value (brightness) and/or higher saturation. From another point of view, a toner of a darker color represents a higher density (optical density), or has a larger light-absorption rate, than a toner of a lighter color if the two toners are applied on a sheet of paper by the same amount. It should be also noted that in a case where black toner is used together with toners of cyan, magenta, and yellow to form an image, "black" is considered as being included in primary colors, and thus, primary colors herein are not necessarily limited to cyan, magenta, and yellow. As will be described later with reference to FIG. 3, image-processing unit 60 generates primary color signals respectively representing an intensity of corresponding primary colors (i.e., cyan, magenta, yellow, and black) from image data provided from control unit 10.

Such dark and light color toners may be formed by, for example, using pigments (coloring agents) of different colors. Alternatively, it is possible to form dark and light color toners using the same pigment in different amounts per a unit amount (or mass) of toner. In this case, the toner having a smaller amount of pigment per unit mass of toner makes a light color toner, and the toner having a larger amount of pigment per unit mass of toner makes a dark color toner. The light color toners, i.e., toners of light cyan, light magenta, light yellow, and light black are examples of a first developer having a relatively light color, and the dark color toners, i.e., toners of dark cyan, dark magenta, dark yellow, and dark black are examples of a second developer having a relatively dark color.

It is to be noted that the developer may be a two-component developer that contains a toner and a carrier.

Figure 2:
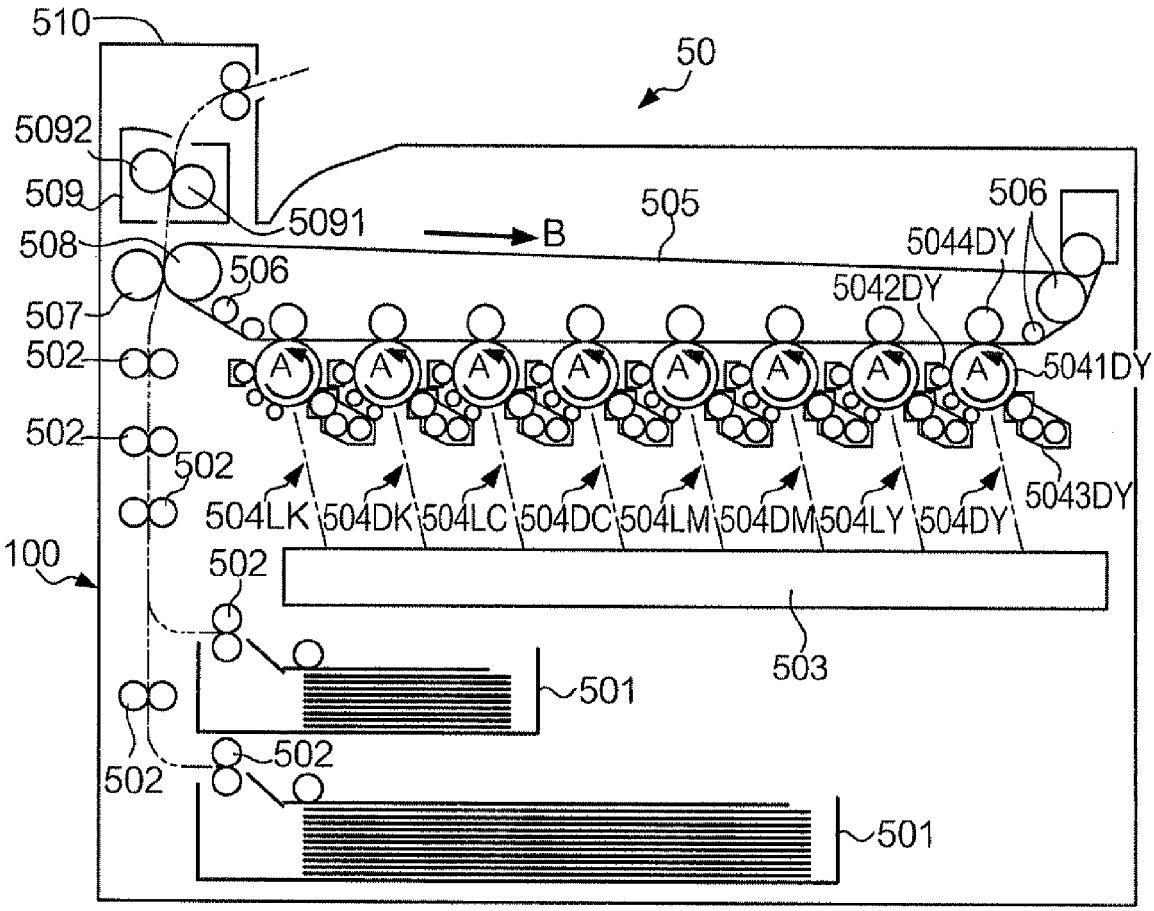
FIG. 2 is a schematic view showing a structure of an image-forming unit 50 according to the exemplary embodiment.

FIG. 2 is a schematic view showing a structure of image-forming unit 50.

Multiple sheet supply units 501 contain recording sheets of different sizes. Each sheet supply unit 501 sends out a recording sheet at a timing instructed by control unit 10. Sheet conveying rolls 502 serve to convey the recording sheet sent out from sheet supply unit 501 to a transfer unit constituted by secondary transfer roll 507 and back-up roll 508. It is to be noted that in this drawing, a conveying path of the recording sheet is indicated by a long dashed double-dotted line. Exposure unit 503 includes a laser emitting source, polygon mirror, etc. to emit laser light toward transfer units 504DY, 504DM, 504DC, 504DK, 504LY, 504LM, 504LC, and 504LK in accordance with the image signal. Transfer units 504DY, 504DM, 504DC, 504DK, 504LY, 504LM, 504LC, and 504LK form respective images using toners of dark yellow, dark magenta, dark cyan, dark black, light yellow, light magenta, light cyan, and light black, respectively, and transfer the formed images to intermediate transfer belt 505, Transfer units 504DY, 504DM, 504DC, 504DK, 504LY, 504LM, 504LC, and 504LK are arranged in this order from upstream with respect to a direction of movement of intermediate transfer belt 505 indicated by arrow B in FIG. 2, and the transfer of images of respective colors is also performed in the same order. It is to be noted that transfer units 504DY, 504DM, 504DC, 504DK, 504LY, 504LM, 504LC, and 504LK differ only with respect to the toner used and otherwise have substantially the same structure. Thus, when it is not necessary to distinguish among these transfer units, they are referred to simply as "transfer unit(s) 504" without a letter in the reference numeral indicating a toner color.

Each transfer unit 504 has photosensitive drum 5041, charging device 5042, development device 5043, and primary transfer roll 5044. Photosensitive drum 5041 has an electric charge generating layer and an electric charge transport layer, and is rotated by a drive unit (not shown in the drawing) in a direction indicated by arrow A in the drawing. Photosensitive drum 5041 is an example of first and second image-holding members. Charging device 5042 functions to charge photosensitive drum 5041 so that photosensitive drum 5041 has a predetermined electric potential. A surface of photosensitive drum 5041 thus charged undergoes an exposure with an exposure beam generated by exposure unit 503, so that an electrostatic latent image is formed on the surface of photosensitive drum 5041. In the following explanation, an exposure area element indicates an area exposed by an exposure beam having the minimum spot radius emitted from exposure unit 503. Exposure unit 503 serves as an example of first and second exposure units that expose first and second image-holding members to form electrostatic latent images. Development device 5043 accommodates toner of one of dark yellow, dark magenta, dark cyan, dark black, light yellow, light magenta, light cyan, and light black, and creates an electric potential difference with respect to the surface of photosensitive drum 5041. The electric potential difference causes toner to adhere to the electrostatic latent image formed on the surface of photosensitive drum 5041, whereby development device 5043 forms a toner image. Thus, development device 5043 serves as an example of first and second development units that develop electrostatic latent images formed by first and second exposure units. Primary transfer roll 5044 is disposed at a position where intermediate transfer belt 505 is opposed to photosensitive drum 5041, and creates an electric potential difference between intermediate transfer belt 505 and photosensitive drum 5041, so that the image is transferred to intermediate transfer belt 505. Intermediate transfer belt 505 is an endless belt member and is supported with tension by belt conveying rolls 506. At least one of belt conveying rolls 506 has a drive unit to circulatingly move intermediate transfer belt 505 in the direction indicated by arrow B in FIG. 2. Belt conveying rolls 506 without a drive unit rotate following the movement of intermediate transfer belt 505. With the circulating movement of intermediate transfer belt 505 in the direction of arrow B in FIG. 2, the image transferred onto intermediate transfer belt 505 by transfer unit 504 is moved to the transfer unit constituted by secondary transfer roll 507 and back-up roll 508. Secondary transfer roll 507 and back-up roll 508 function to create an electric potential difference between intermediate transfer belt 505 and secondary transfer roll 507 so that the image on intermediate transfer belt 505 is transferred onto a recording sheet owing to the electric potential difference. Thus, secondary transfer roll 507 and back-up roll 508 serve as an example of a transfer unit that transfers images developed by first and second development units onto a medium. Fixing unit 509 includes heating roll 5091 and press roll 5092 to apply a heat and pressure on the recording sheet whereby the image that has been transferred to the recording sheet is fixated thereon. Thus, fixing unit 509 causes an image that has been transferred to a medium by the transfer unit to be fixed on the medium.

It is to be noted that in this exemplary embodiment, exposure unit 503 can control an amount of light irradiated onto photosensitive drum 5041 for each exposure area element by changing an intensity of exposure beam and/or an exposure time period in accordance with a below-described toner color signal, to thereby control the electric potential on a corresponding portion of photosensitive drum 5041 and eventually control an amount of toner adhering to a corresponding portion on the medium. Thus, the exposure area element defines a minimum area on the medium in which the amount of toner adhering to the medium can be controlled. In other words, the exposure area element serves as an example of a unit area of a medium on which the first and second developers (such as toners) are applied.

Next, explanation will be made of light color toner and dark color toner.

In general, light color toner is used to improve (or reduce) graininess of an image. Graininess represents a coarseness of an image perceived by a person viewing the image, and is correlated with a number of halftone dots (hereinafter referred to as "dots") contained in a unit area of a recording sheet. For example, if a percentage of a portion covered by toner in a region corresponding to a unit area of a recording sheet (the percentage will be referred to as a "coverage" hereinafter) is 100%, i.e., toner covers all over the region, only the color of toner is perceived by a person and the color of the recording sheet is not perceived. Thus, in such a state, the coarseness of the image is very low and the graininess is improved. On the other hand, if the coverage of dots of toner is 10%, for example, both of the color of toner and the color of the sheet are perceived by a person, and due to a difference in brightness between the portion covered by toner and the portion not covered by toner, the image as a whole will have a coarse appearance. Thus, in this state, the coarseness of the image is high and the graininess is increased. Because light color toner exhibits a lower density than dark color toner of the same amount, a larger amount of light color toner is necessary than dark color toner to represent an image of a given density. Therefore, if an image is reproduced using light color toner in place of dark color toner, the number of dots is increased and hence the coverage is increased, resulting in an improved graininess. Thus, in image-forming apparatus 100, if the coverage calculated from the image data is equal to or greater than a threshold value, the dark color toner is used, and if the calculated coverage is less than the threshold value, light color toner is used to improve the graininess of the image in such low-coverage regions.

Incidentally, in image development, it can happen that toner is scattered to adhere to unintended portions on a recording sheet and/or the image transfer or fixing is insufficient, resulting in dots of toner having an undesirable shape, and these can deteriorate the image quality. To reduce such an image-quality deterioration, it is conceived to first apply light color toner onto a recording sheet, and subsequently apply dark color toner over the light color toner. In comparing a case where dark color toner is applied directly onto a region of a recording sheet and a case where dark color toner is applied over light color toner pre-applied to cover all over a region of a recording sheet, the difference in brightness between a portion applied with dark color toner and a portion surrounding the portion applied with dark color toner is smaller in the latter case, in which the surrounding portion exhibits light color, than in the former case, in which the surrounding portion exhibits the color of the recording sheet, and thus, dots of dark color toner are less conspicuous in the latter case. Therefore, in the latter case, if toner is scattered to an unintended portion of a recording sheet or the shape of a dot of dark color toner becomes undesirable due to insufficient image transfer or fixing, they can be less easily perceived.

However, in some cases, use of light color toner can lower the image quality compared with a case where light color toner is not used. Light color toner is contained in a developer unit (not shown in the drawing) of image-forming apparatus 100 so as to be used to improve the graininess of an image as described above, but an amount of consumption of light color toner can be smaller than dark color toner (such as dark black toner, for example) that is used in reproducing text images that do not require good graininess. If light color toner is retained in the developer unit for an extended period of time, the quality of light color toner can deteriorate. Further, in a case where an image is reproduced using light color toner, an image density change relative to a change of an amount of applied toner tends to be large, and thus the deterioration of quality of light color toner can easily result in color development that is inferior when perceived by a user. Also, it is desirable to take into consideration influences on the image quality imparted by a color of the components, such as a binder, that are contained in the toner in addition to pigment, or imparted by a height of a layer of applied toner from a sheet surface. For example, if an amount of toner adhering to the sheet per exposure area element is too large, the color of the resulting image as a whole can become subdued owing to the color of the binder contained in the toner, or regions with a large toner height may exhibit a higher gloss than the other regions, resulting in varying degrees of gloss across the image.

To address the above problems, image-processing unit 60 determines whether a deterioration of light color toner is likely to take place, and if the determination result is "yes," performs an operation for increasing an amount of consumption of light color toner by replacing a part of dark color toner with light color toner within a range that the image quality is not lowered, in such a manner that the number of dots of toner is unchanged, whereby graininess of an image is unchanged.

Figure 3:
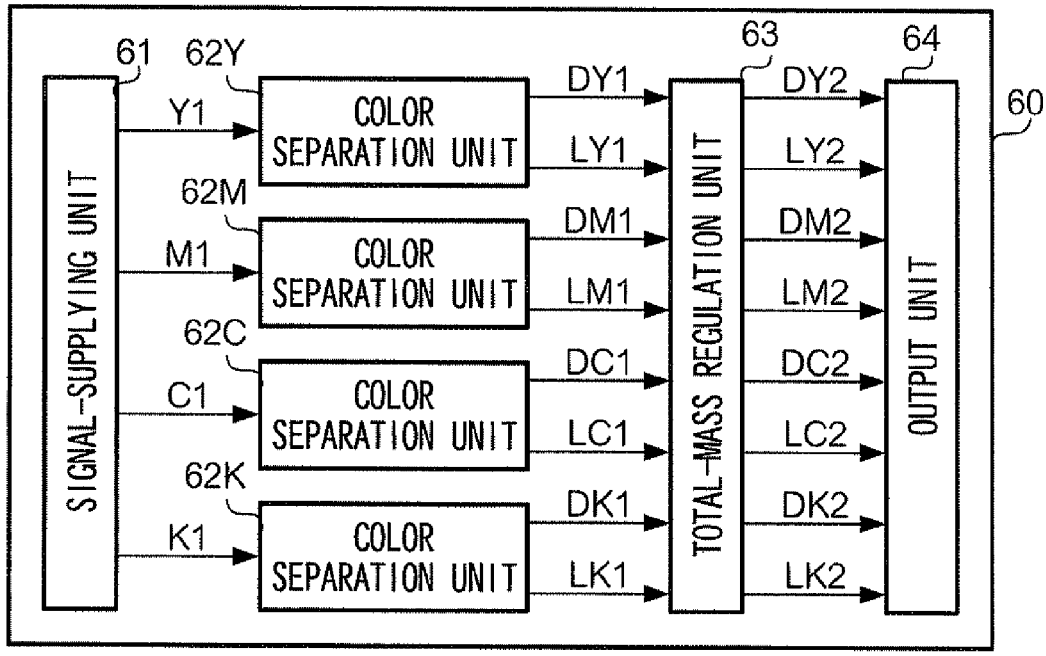
FIG. 3 is a block diagram showing a configuration of image-processing unit 60 according to the exemplary embodiment.

FIG. 3 is a block diagram showing a configuration of image-processing unit 60.

Image-processing unit 60 includes signal-supplying unit 61, color separation units 62Y, 62M, 62C, 62K, total-mass regulation unit 63, and output unit 64. It is to be noted that a letter in each reference symbol assigned to a respective arrow in FIG. 3 represents a color relating to a signal input to or output from any of the above units. For example, a reference numeral C1 represents a signal of cyan. Further, numerals in the reference symbols serve to distinguish signals before and after conversion.

Signal-supplying unit 61 is provided with terminals or the like for electrical connection to control unit 10, and receives image data described in a page description language (PDL). Signal-supplying unit 61 converts the received image data to bitmap format, and generates primary color signals C1, M1, Y1, and K1 corresponding to the four basic colors, cyan, magenta, yellow, and black, respectively, on the basis of a color represented by each pixel of the bitmap. Each primary color signal is an eight-bit signal representing a degree of darkness/lightness (or intensity) of a corresponding color, where when a value of the signal is expressed in decimal form, "0" represents the lightest color and "255" represents the darkest color, for example. Each color separation unit 62Y, 62M, 62C, 62K has a look-up table that defines a characteristic of conversion of a corresponding primary color signal, and according to the look-up table, converts the input primary color signal C1, M1, Y1, or K1 to toner color signals corresponding to the two types of toner, i.e., dark color toner and light color toner. Each toner color signal represents an amount of light color toner or dark color toner that is to adhere to an exposure area element. For example, color separation unit 62Y stores in a memory unit a look-up table that associates a value of primary color signal Y1 to a value of toner color signal DY1 and a value of toner color signal LY1, where toner color signal DY1 corresponds to dark yellow and toner color signal LY1 corresponds to light yellow, and converts primary color signal Y1 to toner color signals DY1 and LY1. Similarly, color separation unit 62M converts primary color signal M1 to toner color signals DM1 and LM1, color separation unit 62C converts primary color signal C1 to toner color signals DC1 and LC1, and color separation unit 62K converts primary color signal K1 to toner color signals DK1 and LK1. The obtained toner color signals are output from the color separation units. Thus, each color separation unit 62Y, 62M, 62C, 62K serves as an example of a first converting unit that converts a primary color signal representing a primary color to a first developer color signal representing an amount of first developer and a second developer color signal representing an amount of second developer.

It should be noted that the memory unit for storing the look-up table may be embodied by multiple memory units provided to respective color separation units 62Y, 62M, 62C, and 62K or may be embodied by a single memory unit shared by the color separation units.

As mentioned above, under a certain condition, color separation units 62Y, 62M, 62C, 62K perform the primary color signal conversion so that the consumption of light color toner is promoted to thereby avoid deterioration of light color toner over time. In the following description, detailed explanation will be made of such a primary color signal conversion performed by color separation units 62Y, 62M, 62C, and 62K.

When each color separation unit 62Y, 62M, 62C, and 62K converts the respective primary color signal using the look-up table, the color separation unit stores in the memory unit an accumulation value of the toner color signal corresponding to the respective light color toner (the accumulation value will be referred to as an "accumulated output" hereinafter). Each accumulated output corresponds to an amount of consumption of toner of light yellow, light magenta, light cyan, or light black contained in development device 5043 of transfer unit 504 of image-forming unit 50, and thus, a smaller value of a time average of the accumulated output (hereinafter referred to as an "time-averaged output") indicates that an average toner consumption rate is low. If the average toner consumption rate is too low, the time period to the next toner supply or replacement can be too long, and the toner deterioration can be unacceptable. The time-averaged output may be obtained by dividing the accumulated output with a number of rotation or a rotating time period of a development roll provided in development device 5043 or photosensitive drum 5041, or by dividing the accumulated output with a time period that has passed from a previous supply of toner to development device 5043, for example. It is to be noted that the values of the accumulated output and the time-averaged output stored in the memory unit of each color separation unit 62Y, 62M, 62C, and 62K are reset to zero when toner is supplied to development device 5043. Thus, the accumulated output is an example of history information of output of a first developer color signal, the time-averaged output is an example of a value representing a rate of consumption of a first developer, and each color separation unit 62Y, 62M, 62C, 62K serves as an example of a selection unit that stores the history information of output of the first developer color signal.

Each color separation unit 62Y, 62M, 62C, 62K determines whether the time-averaged output stored in the memory unit exceeds a threshold value, and if the determination result is "yes," the color separation unit judges that a degree of deterioration of light color toner will not exceed an acceptable level before the next toner supply and selects a first operation mode, and if the determination result is "no," the color separation unit judges that the degree of deterioration of light color toner will exceed the acceptable level before the next toner supply and selects a second operation mode. In other words, each color separation unit 62Y, 62M, 62C, 62K determines a value representing a rate of consumption of light color toner based on the time-averaged output, and if the value is higher than a threshold value, selects the first operation mode, and if not, selects the second operation mode. When the first operation mode is selected, image-processing unit 60 converts the primary color signal into toner color signals for dark and light colors in the same manner as is described in Japanese Patent Application Laid-Open Publication No. 2000-98692, for example, such that if the coverage determined from the image data is equal to or greater than a threshold value, the dark color toner is used, and if the determined coverage is less than the threshold value, light color toner is used in place of black color toner. When the second operation mode is selected, image-processing unit 60 conducts a conversion process similar to that of the first operation mode, except that a larger amount of light color toner and a smaller amount of dark color toner are used to represent a given intensity of primary color. Thus, each color separation unit 62Y, 62M, 62C, 62K serves as an example of a selection unit that selects either a first operation mode or a second operation mode for representing a primary color by a combination of a first developer having a relatively light color of substantially the same hue as the primary color and a second developer having a relatively dark color of substantially the same hue as the primary color, wherein in the second operation mode, a larger amount of the first developer and a smaller amount of the second developer are used to represent a given intensity of the primary color than in the first operation mode.

Explanation will now be made of conversion characteristics in the second mode of respective color separation units 62Y, 62M, 62C, 62K that convert the corresponding primary color signal input from signal-supplying unit 61 into two toner color signals, for dark and light colors.

Figure 4:
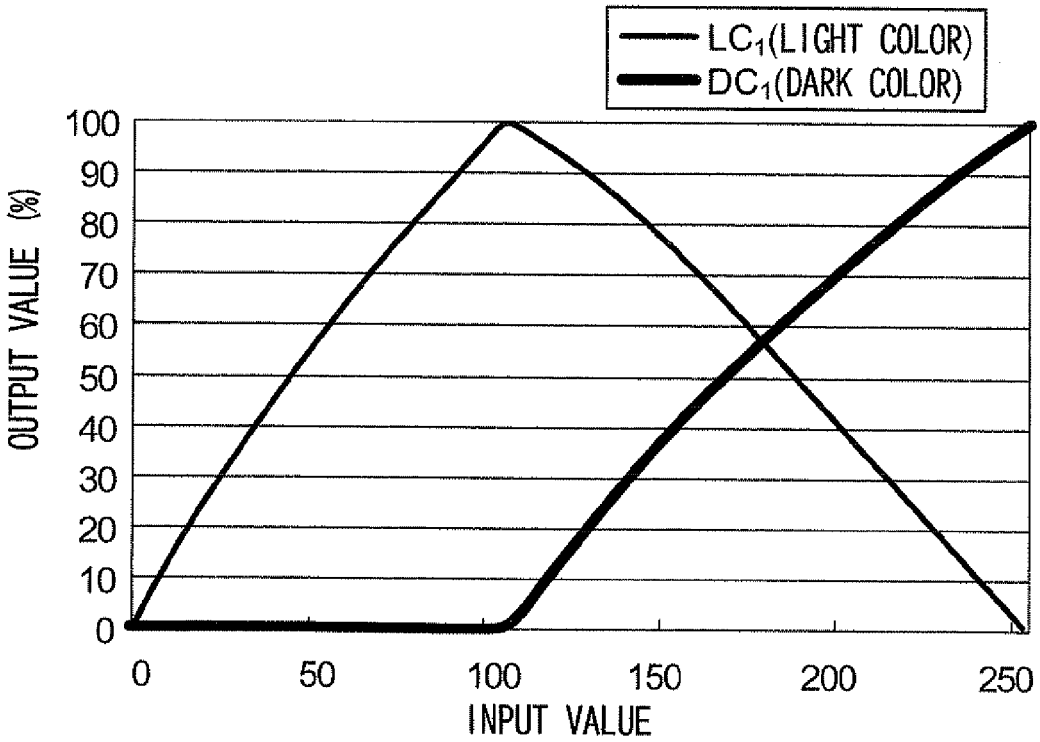
FIG. 4 shows a conversion characteristic of color separation unit 62C according to the exemplary embodiment.

FIG. 4 shows conversion characteristics of color separation unit 62C, for example.

The horizontal axis in the drawing represents a value of primary color signal C1 as an input and the vertical axis represents toner color signals DC1 and LC1 as outputs after conversion. It is to be noted that the values of toner color signals DC1 and LC1 are expressed as a percentage to their maximum values, where the maximum values of toner color signals DC1 and LC1, which are represented as 100% in the drawing, correspond to the maximum amount (or mass) of dark color toner or light color toner that can adhere to the medium (such as a sheet of paper) per an exposure area element. As shown in FIG. 4, in a range where the input is equal to or greater than 0 (zero) and smaller than 100, an intensity (or gradation level) of primary color is represented by adjusting an amount of light color toner value adhering to the sheet per an exposure area element. Thus, as the input increases from 0 to 100, toner color signal LC for light color gradually increases from 0% to 100%, while toner color signal DC for dark color remains at 0%.

In the example shown, because toner color signal LC for light color toner reaches 100% when the input value is 100, an amount of light color toner adhering to the sheet per an exposure area element cannot be further increased in a range of input from 100 to 255. Therefore, as the input increases beyond 100 toward 255, the value of toner color signal LC is gradually decreased from 100% while the value of toner color signal DC is gradually increased. That is, the conversion characteristic of color separation unit 62C is defined such that in a range of input where an image density (or an intensity of the primary color) can be represented only with light color toner, light color toner alone is used, and in a range where an intensity of the primary color cannot be represented with light color toner alone, both of light color toner and dark color toner are used. The conversion characteristics of the other color separation units 62Y, 62M, and 62K are similar to that of color separation unit 62C. That is, the conversion characteristics of color separation units 62Y, 62M, and 62K may be obtained by replacing "DC1" with "DY1," "DM1," and "DK1," respectively, and replacing "LC1" with "LY1," "LM1," and "LK1," respectively. It should be noted, however, that the value of the input (or primary color signal) at which the value of the toner color signal for light color toner reaches 100% may be different between color separation units 62Y, 62M, 62C, and 62K. Each color separation unit 62Y, 62M, 62C, 62K stores in the memory unit the respective conversion characteristic as a look-up table. As described above, in the second operation mode, each color separation unit 62Y, 62M, 62C, 62K uses light color toner in addition to dark color toner to represent the primary color in a range where an input is greater than the threshold value (e.g., 100) and the toner coverage is high. In this way, an amount of consumption of light color toner is increased in the second operation mode more than in the first operation mode in which only dark color toner is used for a range of input beyond the threshold value. In other words, compared with the first operation mode, part of dark color toner for representing the primary color is replaced with light color toner in the second operation mode to thereby increase an amount of light color toner to be consumed. Thus, each color separation unit 62Y, 62M, 62C, and 62K serves as an example of a first conversion unit that converts a primary color signal representing a primary color into a first developer color signal representing an amount of the first developer and a second developer color signal representing an amount of the second developer, wherein when the second operation mode is selected by the selection unit, the first conversion unit conducts the conversion of the primary color signal such that the first developer color signal obtained by the conversion represents a larger amount of the first developer and the second developer color signal obtained by the conversion represents a smaller amount of the second developer for a given value of the primary color signal than in the first operation mode while an area of a medium covered by the first developer and the second developer is unchanged between the first and second operation modes.

Now, referring to FIG. 3 again, total-mass regulation unit 63 calculates a total mass of toner from toner color signals DY1, DM1, DC1, DK1, LY1, LM1, LC1, and LK1, and when the obtained total mass of toner is larger than a prescribed limit value, converts at least one of the toner color signals to generate adjusted toner color signals DY2, DM2, DC2, DK2, LY2, LM2, LC2, and LK2 such that the total mass of toner calculated from the adjusted toner color signals is regulated to be equal to or less than the predetermined limit value. Output unit 64 is provided with a terminal for electrically connecting to image-forming unit 50, and outputs toner color signals DY2, DM2, DC2, DK2, LY2, LM2, LC2, and LK2 to image-forming unit 50.

The limit value for the total mass of toner can be determined depending on a toner composition and/or the configuration of image-forming unit 50. In this exemplary embodiment, the limit value is obtained as a mass of the maximum amount of toner that can adhere to an exposure area element, where the maximum amount of toner that can adhere to the sheet per an exposure area element can be determined based on a color of the binder or other components contained in the toner and/or an influence on the image quality (such as a gloss) imparted by a height of the toner layer from the sheet surface. As described above, if an amount of toner adhering to the sheet per exposure area element is too large, the color of the image as a whole may be subdued or darkened owing to the color of the binder contained in the toner, and if the height of the layer of toner adhering to portions of the sheet is too large, the difference in gloss between such toner-adhering portions and the toner-absent portions can be unacceptable. The limit value (or upper limit) for the total mass of toner is provided to avoid these problems. For example, if the limit value is represented by a reference LIM, total-mass regulation unit 63 determines whether a condition DY1+LY1+DM1+LM1+DC1+LC 1+DK1+LK1≦LIM holds, and if the determination result is "yes," outputs the input signals DY1, DM1, DC1, DK1, LY1, LM1, LC1, and LK1 without conversion as output signals DY2, DM2, DC2, DK2, LY2, LM2, LC2, and LK2 to output unit 64. On the other hand, if the determination result is "no," i.e., DY1+LY1+DM1+LM1+DC1+LC1+DK1+LK1>LIM, converts the toner color signals for the light color toners to reduce an amount of the light color toners, and converts the toner color signals for the dark color toners to increase an amount of the dark color toners.

A concrete explanation will be given below, taking toner color signals DY1 and LY1 as an example. When a certain intensity of primary color (yellow) is represented by a combination of a value of toner color signal DY1 that is equal to DY1-1 and a value of toner color signal LY1 that is equal to LY1-1, this intensity of yellow can be represented by another combination of these toner color signals, i.e., by a value of toner color signal DY1 that is different from DY1-1 and a value of toner color signal LY1 that is different from LY1-1. This is because an intensity of primary color (e.g., yellow) that is represented by a certain amount of light color toner (e.g., light yellow toner) can be represented by a smaller amount of dark color toner (e.g., dark yellow toner). Thus, plural combinations of values of toner color signals DY1 and LY1 can exist for a given intensity of yellow. Total-mass regulation unit 63 stores some of these combinations, selects a combination of values of DY1 and LY1 such that the condition DY1+LY1+DM1+LM1+DC1+LC1+DK1+LK1≦LIM is satisfied, and outputs the selected values of DY1 and LY1 as values of adjusted toner color signals DY2 and LY2. In this way, when the calculated total mass of toner exceeds the limit value, total-mass regulation unit 63 converts the toner color signals so as to decrease a mass of light color toners rather than decreasing a mass of dark color toners. Thus, total-mass regulation unit 63 serves as an example of a second conversion unit that determines, for each exposure area element, whether a total of the amount of the first developer and the amount of the second developer represented by the first toner color signal and the second toner color signal, respectively, exceeds a threshold value, and if the determination result is "yes," converts the first and second toner color signals to decrease the amount of the first developer represented by the first toner color signal and increase the amount of the second developer represented by the second toner color signal.

Figure 5:
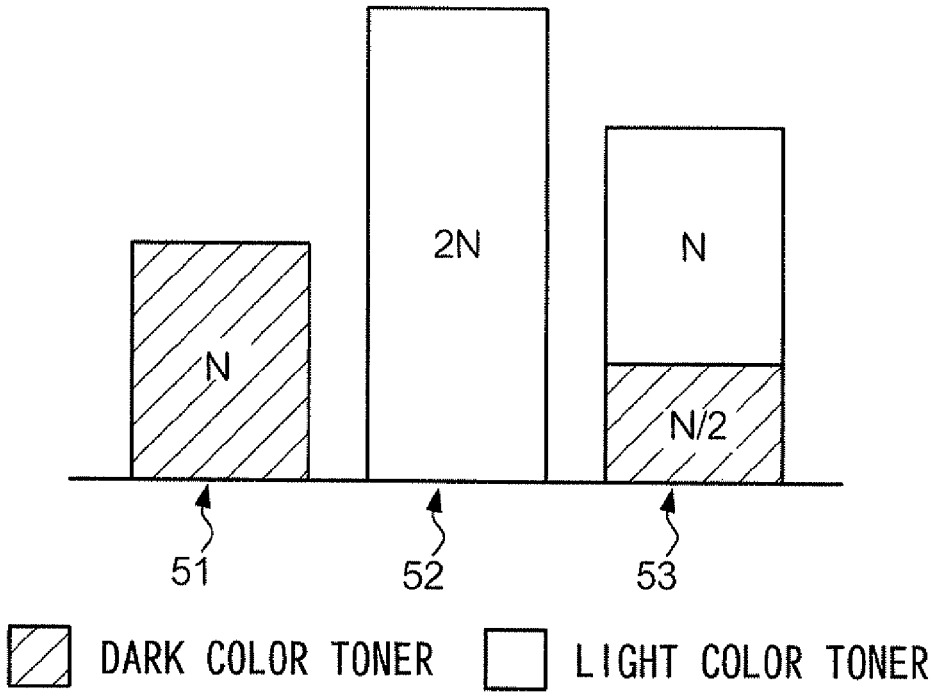
FIG. 5 is a cross-sectional view showing a cross-section of images formed on a recording sheet according to the exemplary embodiment.

FIG. 5 is a schematic cross-sectional view showing a cross-section of ages formed on a recording sheet.

Image 51 represents an image formed according to certain image data 5 only with dark color toner without the color separation performed by color separation units 62Y, 62M, 62C, and 62K of image-processing unit 60. It is assumed that image 51 is formed by using N number of dark color toner particles. Also, it is assumed that dark color toner contains twice as many pigments per unit mass as light color toner.

Image 52 represents an image formed according to the same image data 5 using dark color toner and light color toner after the color separation conducted by color separation units 62Y, 62M, 62C, and 62K of image-processing unit 60. In the example shown, image 52 corresponds to a case where the input (primary color signal) is in a range from zero to 100 in FIG. 4, and all of N number of dark color toner particles forming image 51 are replaced with light color toner particles to form image 52, where image 52 contains 2N number of light color toner particles.

Image 53 represents an image formed according to the same image data 5 in a case where after the color separation conducted by color separation units 62Y, 62M, 62C, and 62K of image-processing unit 60, total-mass regulation unit 63 further converts the toner color signals to regulate the total amount of toner. In the example shown, a half of the N number of dark color toner particles forming image 51 remains unchanged and the other half of the N number of dark color toner particles are replaced with N number of light color toner particles to form image 53.

It should be noted that among images 51, 52, and 53 which are formed with dark color toner alone, light color toner alone, and a combination of dark and light color toners, respectively, only the mass of toner applied to the sheet per an exposure area element (or the height of toner applied to the sheet per an exposure area element from the surface of the sheet) varies, and the toner coverage and hence the graininess of the image is unchanged. Thus, image-forming unit 50 controls the mass of light color toner and dark color toner forming each dot of an image to promote the consumption of light color toner in certain cases, without varying the number of dots (halftone dots) per unit area of the recording sheet or a dot size.

(2) Modified Embodiments (2-1) Modified Embodiment 1

Image-forming apparatus 100 may adopt a recording technique other than electrophotography. Also, instead of toner, image-forming apparatus 100 may use another color material, such as ink. The configuration of image-forming unit 50 is not limited to the foregoing exemplary embodiment, and image-forming unit 50 may include a rotary developing device, in which multiple developer units rotate as a unitary body, and a fixing device that utilizes a flash of light to fix toner on a recording sheet. Also, the number of toners contained in transfer unit 504 is not limited to 8 as in the above-described embodiment, and the types of toner that may be used are also not limited to those used in the above-described embodiment.

(2-2) Modified Embodiment 2

The functions performed by image-processing unit 60 may be implemented by one or more hardware devices, or may be implemented as a program that can be executed by a computer. Such a program may be provided in a form stored in a storage medium such as an optical disk, or may be provided in a form that can be downloaded from an external device such as a server.

(2-3) Modified Embodiment 3

The primary color signal and the toner color signal after color separation may be any signal that can represent an amount of color material. In the foregoing exemplary embodiment, the value of the primary color signal and the value of the toner color signal increase to represent a darker color. However, it may be possible that a larger value of these signals represents a lighter color similarly to a larger value of brightness representing a lighter color. In such a case, unlike the above-described exemplary embodiment, the value of the primary color signal or the toner color signal increases to decrease an amount of color material to be used.

(2-4) Modified Embodiment 4

In FIG. 5, image 51 is constituted by N number of dark color toner particles and image 52 is constituted by twice as many (i.e., 2N number of) light color toner particles. However, an influence of a color of the binder included in toner becomes larger as an amount of toner increases, and this may be taken into account to determine the relationship between an amount of dark color toner and an amount of light color toner that represent a given intensity of primary color. In such a case, it may be possible to represent an intensity of primary color using an additional toner having a color different from those of the dark and light color toners, and the look-up table may define the conversion characteristic reflecting such a condition.

(2-5) Modified Embodiment 5

As shown in FIG. 4, in the second operation mode, each color separation unit 62Y, 62M, 62C, 62K represents primary color using only light color toner in a range of input equal to or smaller than a threshold value, and represents a primary color using both of dark color toner and light color toner in a range of input exceeding the threshold value. However, each color separation unit 62Y, 62M, 62C, 62K in the second operation mode may represent a primary color using both of dark color toner and light color toner without using the threshold value.

(2-6) Modified Embodiment 6

In the foregoing exemplary embodiment, each color separation unit 62Y, 62M, 62C, 62K selects the first operation mode or the second operation mode based on the time-averaged output, which represents a past tendency of consumption of light color toner. However, it may be possible to predict a future consumption of light color toner and select the first or second operation mode taking into consideration the predicted future toner consumption. One concrete approach to achieving this is described below. Each color separation unit 62Y, 62M, 62C, 62K calculates a toner coverage for each primary color from a newly received group of image data. In a case where the calculated coverage indicates a high density, it can be predicted that if the first operation mode is selected, only dark color toner will be used and hence no consumption of light color toner will take place, leading to deterioration of light color toner. Therefore, in forming an image that will consume only dark color toner if the first operation mode is selected, the color separation unit may select the second operation mode to promote consumption of light color toner.

(2-7) Modified Embodiment 7

Image-processing unit 60 may have multiple operation modes that can be selected by a user so that different values of the total-mass limit value are set for respective operation modes. For example, in one operation mode, the total-mass limit value may be set high, whereby the consumption of light color toner is promoted, and in another operation mode, the total-mass limit value may be set low, whereby the consumption of light color toner is promoted to a lesser extent.

(2-8) Modified Embodiment 8

In the foregoing exemplary embodiment, when the total mass of toner exceeds a limit value, total-mass regulation unit 63 performs a conversion (or adjustment) of toner color signals so as to decrease a mass of light color toners rather than decreasing a mass of dark color toners, to thereby reduce influences on the image quality imparted by a color of the binder or other components contained in toner in addition to the pigment or imparted by a height of toner layer from a sheet surface.

However, total-mass regulation unit 63 may reduce the influence of the color of the binder or other components included in toner other than pigment by conducting conversion or adjustment of not only a combination of dark color toner and light color toner corresponding to a single primary color, but also a combination of dark color toner and light color toner corresponding to another primary color. For example, total-mass regulation unit 63 may store in the memory unit a look-up table that shows the characteristics of color of the binder or other components included in toner, and carry out the conversion or adjustment of toner color signals according to the look-up table such that the influence of color of the binder or other components is reduced or canceled.

(2-9) Modified Embodiment 9

In the foregoing exemplary embodiment, each color separation unit 62Y, 62M, 62C, 62K selects the second operation mode to increase an amount of consumption of light color toner when it is determined that the consumption rate of light color toner is smaller than a prescribed rate.

However, the color separation in the second operation mode may be conducted with a higher priority for image portions having a color represented by a combination of a smaller number of primary colors than for image portions having a color represented by a combination of a larger number of primary colors, because the color separation in the second operation mode for an image portion having a color represented by a combination of a larger number of primary colors can result in a larger height of toner layer from a sheet surface. For example, it is possible to conduct color separation in the second operation mode for image portions having a color of magenta, which is represented by only a toner color signal of magenta, but not to conduct color separation in the second operation mode for image portions having a color of green, which is represented by a combination of a toner color signal of magenta and a toner color signal of yellow.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-processing device comprising:

a selection unit that selects either a first operation mode or a second operation mode for representing a primary color by a combination of a first developer having a relatively light color of substantially the same hue as the primary color and a second developer having a relatively dark color of substantially the same hue as the primary color, wherein in the second operation mode, a larger amount of the first developer and a smaller amount of the second developer are used to represent a given intensity of the primary color than in the first operation mode; and a first conversion unit that converts a primary color signal representing the primary color into a first developer color signal representing an amount of the first developer and a second developer color signal representing an amount of the second developer, wherein when the second operation mode is selected by the selection unit, the first conversion unit converts the primary color signal such that the first developer color signal obtained by the conversion represents a larger amount of the first developer and the second developer color signal obtained by the conversion represents a smaller amount of the second developer for a given value of the primary color signal than in the first operation mode, while an area of a medium covered by the first developer and the second developer is unchanged between the first and second operation modes.

2. The image-processing device according to claim 1, further comprising a second conversion unit that determines, for each unit area of a medium on which the first and second developers are to be applied, whether a total of the amount of the first developer and the amount of the second developer represented by the first and second developer color signals, respectively, exceeds a threshold value, and if it is determined that the total amount of the first and second developers exceeds the threshold value, converts the first and second developer color signals to decrease the amount of the first developer represented by the first developer color signal and to increase the amount of the second developer represented by the second developer color signal so as to make the total amount of the first and second developers equal to or smaller than the threshold value.

3. The image-processing device according to claim 2, wherein the threshold value is an upper limit of the amount of the first and second developers that can adhere to a unit area of the medium, the upper limit being determined based on a color of a binder included in the first and second developers and a height of a layer formed by the first and second developers from a surface of the medium.

4. The image-processing device according to claim 2, wherein the second conversion unit further performs adjustment of a developer color signal corresponding to a primary color signal representing another primary color to reduce an influence of a color of a binder included in the developers.

5. The image-processing device according to claim 1, wherein the selection unit stores history information of output of the first developer color signal, and calculates from the history information a value representing a rate of consumption of the first developer, the selection unit selecting the first operation mode when the value exceeds a threshold value and selecting the second operation mode when the value is equal to or smaller than the threshold value.

6. The image-processing device according to claim 1, wherein the first color conversion unit conducts the conversion in the second operation mode with a higher priority for portions of an image having a color represented by a combination of a smaller number of primary colors than for image portions of the image having a color represented by a combination of a larger number of primary colors.

7. An image-forming apparatus comprising:

the image-processing device according to claim 1;

a first image-holding member that holds an image;

a first exposure unit that exposes the first image-holding member with an amount of light corresponding to the first developer color signal provided from the first conversion unit, so as to form an electrostatic latent image on the first image-holding member;

a first development unit that develops the electrostatic latent image formed on the first image-holding member by the first exposure unit, the first development unit using the first developer to develop the electrostatic latent image;

a second image-holding member that holds an image;

a second exposure unit that exposes the second image-holding member with an amount of light corresponding to the second developer color signal provided from the first conversion unit, so as to form an electrostatic latent image on the second image-holding member;

a second development unit that develops the electrostatic latent image formed on the second image-holding member by the second exposure unit, the second development unit using the second developer to develop the electrostatic latent image;

a transfer unit that transfers the images developed by the first and second development units to a medium; and a fixing unit that fixes the images transferred to the medium on the medium.

8. An image-processing method comprising:

selecting either a first operation mode or a second operation mode for representing a primary color by a combination of a first developer having a relatively light color of substantially the same hue as the primary color and a second developer having a relatively dark color of substantially the same hue as the primary color, wherein in the second operation mode, a larger amount of the first developer and a smaller amount of the second developer are used to represent a given intensity of the primary color than in the first operation mode; and conducting a conversion of a primary color signal representing the primary color into a first developer color signal representing an amount of the first developer and a second developer color signal representing an amount of the second developer, wherein when the second operation mode is selected, the conversion of the primary color signal is conducted such that the first developer color signal obtained by the conversion represents a larger amount of the first developer and the second developer color signal obtained by the conversion represents a smaller amount of the second developer for a given value of the primary color signal than in the first operation mode, while an area of a medium covered by the first developer and the second developer is unchanged between the first and second operation modes.

9. A computer-readable medium storing a program causing a computer to execute a process for processing an image, the process comprising:

selecting either a first operation mode or a second operation mode for representing a primary color by a combination of a first developer having a relatively light color of substantially the same hue as the primary color and a second developer having a relatively dark color of substantially the same hue as the primary color, wherein in the second operation mode, a larger amount of the first developer and a smaller amount of the second developer are used to represent a given intensity of the primary color than in the first operation mode; and conducting a conversion of a primary color signal representing the primary color into a first developer color signal representing an amount of the first developer and a second developer color signal representing an amount of the second developer, wherein when the second operation mode is selected, the conversion of the primary color signal is conducted such that the first developer color signal obtained by the conversion represents a larger amount of the first developer and the second developer color signal obtained by the conversion represents a smaller amount of the second developer for a given value of the primary color signal than in the first operation mode, while an area of a medium covered by the first developer and the second developer is unchanged between the first and second operation modes.

* * * * *